US005463997A

United States Patent [19]

Cutler

[11] Patent Number: 5,463,997

[45] Date of Patent: Nov. 7, 1995

[54] SINGLE POINT FUEL INJECTION SYSTEM

[75] Inventor: David K. Cutler, Plantation, Fla.

[73] Assignee: Cutler Induction Systems, Inc., North Miami Beach, Fla.

[21] Appl. No.: 318,279

[22] Filed: Oct. 5, 1994

[51] Int. Cl.[6] ..... F02M 51/06; F02M 25/00

[52] U.S. Cl. ..... 123/460; 123/531; 123/585; 239/585.1

[58] Field of Search ..... 123/457, 460, 123/531, 533, 585; 239/408, 412, 585.1–585.5, 900

[56] References Cited

U.S. PATENT DOCUMENTS

| | | | |
|---|---|---|---|
| 3,460,520 | 8/1969 | Huber | 123/450 |
| 4,404,947 | 9/1983 | Swanson | 123/527 |
| 4,465,050 | 8/1984 | Igashira et al. | 123/472 |
| 4,570,598 | 2/1986 | Samson et al. | 132/445 |
| 4,646,706 | 3/1987 | Emmenthal | 123/585 |
| 4,708,117 | 11/1987 | Mesenich et al. | 123/533 |
| 4,712,524 | 12/1987 | Smith et al. | 123/198 A |
| 4,754,740 | 7/1988 | Emmenthal et al. | 123/533 |
| 4,798,329 | 1/1989 | Mesenich | 239/5 |
| 4,840,163 | 6/1989 | Alsobrooks et al. | 123/533 |
| 4,909,220 | 3/1990 | Field et al. | 123/468 |
| 4,925,112 | 5/1990 | Wahba | 239/585 |
| 4,958,773 | 9/1990 | Stettner et al. | 239/584 |
| 4,958,774 | 9/1990 | Taylor | 239/584 |
| 4,993,394 | 2/1991 | McKay et al. | 123/533 |
| 5,004,162 | 4/1991 | Stettner et al. | 239/585 |
| 5,082,184 | 1/1992 | Stettner et al. | 239/408 |
| 5,099,814 | 3/1992 | Ament | 123/450 |
| 5,119,793 | 6/1992 | Stoltman | 123/533 |
| 5,121,719 | 6/1992 | Okazaki et al. | 123/179.14 |
| 5,127,584 | 7/1992 | Sczomak | 239/533.11 |
| 5,269,281 | 12/1993 | Hafner | 123/531 |
| 5,312,050 | 5/1994 | Schumann et al. | 239/585.1 |
| 5,353,767 | 10/1994 | Carbone et al. | 123/470 |
| 5,360,166 | 11/1994 | Nogi et al. | 239/404 |

*Primary Examiner*—Tony M. Argenbright
*Attorney, Agent, or Firm*—Holland & Knight

[57] ABSTRACT

A combined fuel regulator and single point metering system comprises a diaphragm-type fuel regulator mounted at one end of a single point injector which carries a solenoid valve operated plunger movable with respect to a fuel distribution block located within the hollow interior of the injector base. The injector base is divided into a fuel outlet cavity located on one side of the fuel distribution block, and an air chamber located on the opposite side which is connected by a one-way valve to source of ambient air, and is also adapted for connection to a turbocharger or the like. The fuel distribution block is formed with a number of passages each directly connected to an air-fuel nozzle within which the fuel and air are intermixed for delivery through separate tubes to each of the cylinders of an internal combustion engine.

34 Claims, 2 Drawing Sheets

20
22
30
31
24
12
40
28
46
42
26
48
36
54
34
38
58
52
32
10
50
44
70
60
68
64
62
72
98
96
108
128
74
90
14
76
94
66
88
140
84
84
82
78
136
106
124
92
138
86
126
134
130
182
182
104
112
80
114
164
132
146
166
166
144
164
142
180
146
180
176
120
176
144
100
102
122
110
118
116

SINGLE POINT FUEL INJECTION SYSTEM

FIELD OF THE INVENTION

This invention relates to fuel injection systems, and, more particularly, to a fuel injection system in which a mixture of atomized fuel and air is distributed from a single injector through separate lines to each cylinder of an internal combustion engine.

BACKGROUND OF THE INVENTION

Fuel injection systems for internal combustion engines typically fall into one of two general categories. One type of fuel injection system is a "throttle body" system wherein one or more fuel injectors combine fuel with the flow of air entering a throttle valve connected to the engine intake manifold. The fuel is atomized and intermixed with the air flow in the course of movement through the throttle valve and intake manifold. The intake manifold distributes the air-fuel mixture into the inlet ports of each engine combustion chamber.

Another category of fuel injection systems is the "port system" in which a separate fuel injector is provided for each cylinder of the internal combustion engine. These fuel injectors are mounted on a fuel rail carried by the intake manifold from which they receive a supply of fuel. Each injector is effective to transmit a precisely metered quantity of atomized fuel directly into the inlet port of one of the cylinders of the engine.

Throttle body fuel injection systems and port fuel injection systems of the type described above each have advantages and disadvantages, which, to at least some extent, limits their efficiency and/or practicality in some applications. Throttle body fuel injection systems have the advantage of lower cost because only a limited number of fuel injectors are required to intermix the fuel with the flow of air entering the throttle valve of the engine. The problem with such systems is that engine performance can suffer as a result of incomplete fuel atomization, uneven intermixture of air and fuel, and/or improper distribution of the air-fuel mixture to each of the individual cylinders of the engine. Some of these problems are overcome by port fuel injection systems because each cylinder of the engine is provided with its own fuel injector. Nevertheless, the fuel rails and large number of injectors required in port fuel injection systems are costly compared to throttle body fuel injection systems.

The advantages and disadvantages of the fuel injection systems described above has prompted the development of alternative systems, such as those disclosed in U.S. Pat. No. 5,082,184 to Stettner et al. and U.S. Pat. No. 4,570,598 to Samson et al. In fuel injection systems of this type, a single injector is employed to distribute accurately metered quantities of fuel into each of a number of tubes leading to the respective cylinders of the internal combustion engine. These systems eliminate the need for separate electronic fuel injectors for each cylinder as in port fuel injection sytems, but more accurately and effectively intermix and distribute the air-fuel mixture to the engine cylinders compared to throttle body injection systems. The single point fuel injection system disclosed in the U.S. Pat. No. 4,570,598 to Samson et al., for example, includes an injector housing formed with a fuel collection chamber within which a ball valve is movable with respect to the inlets of a number of fuel orifices formed in an injector tip. Each of the fuel orifices has an outlet which is oriented in alignment with a respective fuel distribution passage formed in the injector housing. Each fuel distribution passage, in turn, is connected by a separate line to one of the cylinders of an internal combustion engine. Fuel is introduced into each of the fuel orifices when the ball valve is opened, and then a separate stream of fuel is ejected from each orifice into an air chamber at the base of the injector housing toward one of the fuel distribution passages. In the course of movement through the air chamber, the fuel is intermixed with the air so that an air-fuel mixture enters a respective fuel distribution passage for supply to the cylinders of the engine.

Air-assist single point injector systems such as that disclosed in U.S. Pat. No. 4,570,598 suffer from a number of limitations. Because the fuel orifices in the injector tip are physically spaced across an air chamber from the fuel distribution passages in the injector housing, dirt and debris in the fuel or within the air entering the air chamber can collect within the fuel orifices and fuel distribution passages. This can clog the fuel orifices or at least cause a sufficient obstruction so that the fuel cannot be smoothly directed from the fuel orifices into the fuel distribution passages. Further, in addition to problems of clogging, the heat from the engine can cause fuel to varnish or coke within the interior of the fuel injector. If such deposits accumulate at the discharge end of the fuel orifices, the stream of fuel emitted therefrom may be completely blocked or misdirected to such an extent that it contacts a wall of the injector housing rather than entering a fuel distribution passage.

In addition to the problems noted above, single point metering systems of the type disclosed in U.S. Pat. No. 4,570,598 may not effectively atomize and intermix the fuel and air before it is supplied to the cylinders of the engine. It is believed that whatever atomization of the fuel which does take place in systems of this type occurs within the lines leading from the injector housing to each cylinder. Little or no atomization could occur within the air chamber across which the fuel is transmitted from the fuel orifices to the fuel distribution passageways, because a plume or spray of air and fuel would form which would prevent at least a portion of the fuel from entering the fuel distribution passages. Consequently, atomization of the fuel and intermixture of the atomized fuel with air is not as complete as desired, and can therefore result in loss of engine performance and increased hydrocarbon emissions.

A still further limitation of the single point metering system disclosed in U.S. Pat. No. 4,570,598 is that it cannot be utilized with forced induction systems such as turbochargers and superchargers. In such system, pressurized air is introduced from a turbocharger or supercharger for intermixture with the fuel. But the air chamber of U.S. Pat. No. 4,570,598 is designed to receive only ambient pressure air and is provided with a vent which would prevent pressurization of the air chamber above ambient. As such, turbochargers or superchargers would not be effective in enhancing engine performance with the single point metering system described in U.S. Pat. No. 4,570,598.

SUMMARY OF THE INVENTION

It is therefore among the objectives of this invention to provide a single point metering system for internal combustion engines which dispenses accurately metered quantities of air-fuel mixture to each cylinder of the internal combustion engine, which effectively atomizes the fuel and completely intermixes it with air prior to supply to the engine cylinders, which is capable of delivering a substantial volume of air-fuel mixture to the engine, and, which is capable of being utilized with forced inductin types of fuel injection systems such as turbochargers and superchargers.

These objectives are accomplished in a combined fuel regulator and single point metering system which comprises a diaphragm type fuel regulator mounted at one end of a single point injector which carries a solenoid valve operated plunger movable with respect to a fuel distribution block located within the hollow interior of the injector base. The injector base is divided into a fuel outlet cavity located on one side of the fuel distribution block, and an air chamber located on the opposite side which is connected by a one-way valve to source of ambient air, and is also adapted for connection to a turbocharger or the like. The fuel distribution block is formed with a number of passages each directly connected to an air-fuel nozzle within which the fuel and air are intermixed for delivery through separate tubes to each of the cylinders of an internal combustion engine.

One aspect of this invention is predicated upon the concept of ensuring that the fuel is properly atomized and intermixed with air prior to delivery to the cylinders of an internal combustion engine, while substantially eliminating potential problems of clogging or other interference with the transfer of the air-fuel mixture from the metering device to the engine cylinders. As mentioned above, systems of the type disclosed in U.S. Pat. No. 4,570,598 depend upon the transmission of a stream of fuel across an air gap between two orifices or passages so that the fuel can be intermixed with the air prior to distribution to the engine cylinders. Dirt and debris within the fuel or air can clog such passages, thus blocking or altering the flow path of the fuel across the air gap. This problem is eliminated in the metering device of this invention by the provision of air-fuel nozzles which are directly connected to a respective fuel distribution passage in the fuel distribution block, and which include a number of air inlet ports positioned within the air chamber of the injector base. Fuel entering the fuel distribution block is transmitted to each of the fuel distribution passages, and, in turn, to the air-fuel nozzle associated with each passage. In the course of movement through such nozzles, the fuel is intermixed with air entering the air inlet ports of the nozzles. The air-fuel mixture then flows through a separate tube connected at one end to each air-fuel nozzle, and at the other end to a nozzle injector mounted in position to introduce the air-fuel mixture into the inlet port of an engine cylinder.

One advantage of this construction of the subject invention is that there is an essentially closed flow path for the fuel from the regulator, through the single point injector and its fuel distribution block, and then into each of the air-fuel nozzles leading to the engine cylinders. Operation of the single point injector herein does not depend on "aiming" or directing a fuel flow across an air gap. Even if the fuel flow path noted above were to become partially clogged, the fuel would nevertheless be directed into each of the air-fuel nozzles as required. Additionally, each air-fuel nozzle is formed with a number of air inlet ports which ensures that the required flow of air is delivered into such nozzles even if one or more of the air inlet ports should become partially or completely obstructed.

Another aspect of this invention is predicated upon the ability of the injector herein to be utilized with systems such as turbochargers or superchargers. In the presently preferred embodiment, a diaphragm-type fuel regulator is directly mounted to the single point injector of this invention, and each provides a substantially constant pressure flow of fuel into the fuel outlet cavity of the injector base. The fuel regulator is formed with a housing having a fuel inlet cavity and a back pressure cavity separated by the flexible diaphragm of a diaphragm regulator having a regulator tip movable with respect to the inlet of a dump passage formed in the housing. The back pressure cavity is connected by an internal or external line to the air chamber within the injector base.

Under normal operating conditions, wherein the air chamber of the injector receives ambient air through the one-way valve noted above, fuel entering the regulator is transferred from the fuel inlet cavity through a flow path in the injector to the fuel outlet cavity, as described above. The diaphragm regulator is movable with respect to the dump passage so that in the event of a surge in pressure of the fuel entering the regulator, the diaphragm and regulator tip are movable to an open position to dump excess fuel through the dump passage and thus maintain the fuel supplied to the injector at a substantially constant pressure. As a result, a substantially constant pressure drop is maintained between the fuel outlet cavity on one side of the fuel distribution block in the injector, and the the distribution passages within the fuel distribution block.

When the injector of this invention is employed with a turbocharger or supercharger, pressurized air is introduced through a separate air inlet formed in the injector base into the air chamber therein. This flow of pressurized air increases the pressure within the air chamber, the air-fuel nozzles and the distribution passages in the fuel distribution block, compared to the pressure therein when ambient air is introduced into the air chamber through the one-way valve. The one-way valve allows increased pressurization of the air chamber by blocking the flow of air outwardly therethrough. In order to maintain the same pressure drop between the fuel outlet cavity of the injector and the distribution passages within the fuel distribution block, pressurized air introduced into the air chamber by the turbocharger or supercharger is transmitted into the back pressure cavity of the fuel regulator where it exerts a force against the diaphragm of the regulator which urges the regulator tip against the inlet of the dump passage. As a result, the pressure of the fuel entering the fuel inlet cavity of the regulator can be increased to the same extent as the pressure of the air within the air chamber and back pressure cavity without unseating the regulator tip. This insures that the same pressure drop is provided between the fuel outlet cavity and the distribution passages within the fuel distribution block when using a turbocharger or supercharger, as exists therebetween when the injector of this invention is employed with a standard system utilizing ambient air.

In the presently preferred embodiment, a number of air-fuel nozzle designs are utilized to intermix the fuel and air prior to transmission to separate tubes connected to injectors located at the engine cylinders. In several embodiments, the air inlet ports are oriented substantially perpendicular to the longitudinal axis of the nozzles and intersect a throughbore formed therein at a 90° angle. Preferably, at least four air inlet ports, spaced 90° apart, are provided in each of such nozzle designs. Alternatively, the air inlet ports are formed at an angle with respect to the longitudinal axis of the air-fuel nozzle so that incoming air is directed substantially tangent to the flow of fuel through the nozzle. It is believed that this construction provides even better intermixture of the air with the fuel before it is directed from the air-fuel nozzle into the lines leading to the engine cylinders.

A still further advantage of the invention is that the fuel regulator and single point injector are mounted directly to one another and function essentially as an integral unit. Because of the proximity of the regulator to the injector, response times are significantly reduced compared to conventional fuel injection systems. That is, corrections or adjustments to the pressure of the fuel entering the regulator are quickly transferred to the injector due to the short physical distance therebetween so that the appropriate quantity of fuel is discharged from the injector to each of the air-fuel nozzles when the solenoid valve is actuated. Such rapid adjustments cannot be made in other fuel injection systems where the regulator and injector(s) are spaced a comparatively large distance apart.

Additionally, the provision of a combined fuel regulator and single point injector simplifies adjustment of the system to deliver the required quantity of fuel in a given time period. In prior systems, fuel flow had to be "tuned" or adjusted by varying the distance of travel of the valve plunger of the solenoid valve and/or adjusting the tension of the return spring associated with the valve plunger in order to unseat the valve plunger for a sufficient period of time to allow the required quantity of fuel to exit the injector(s) and flow to the engine cylinders. Such adjustments are difficult to make, and it is also difficult to obtain constently equivalent performance from one injector system to another. These problems are substantially eliminated in this invention because fuel flow adjustment is made by simply varying the position of the adjustment screw associated with the diaphragm regulator at the fuel regulator. Such adjustment varies the pressure of the fuel discharged from the pressure regulator into the single point injector, and, hence, alters the flow of fuel emitted from the injector to the air-fuel nozzles with the operation of solenoid valve remaining the same. As a result, no adjustment of the solenoid valve operation is needed thus greatly simplifying the overall initial set-up or tuning operation.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
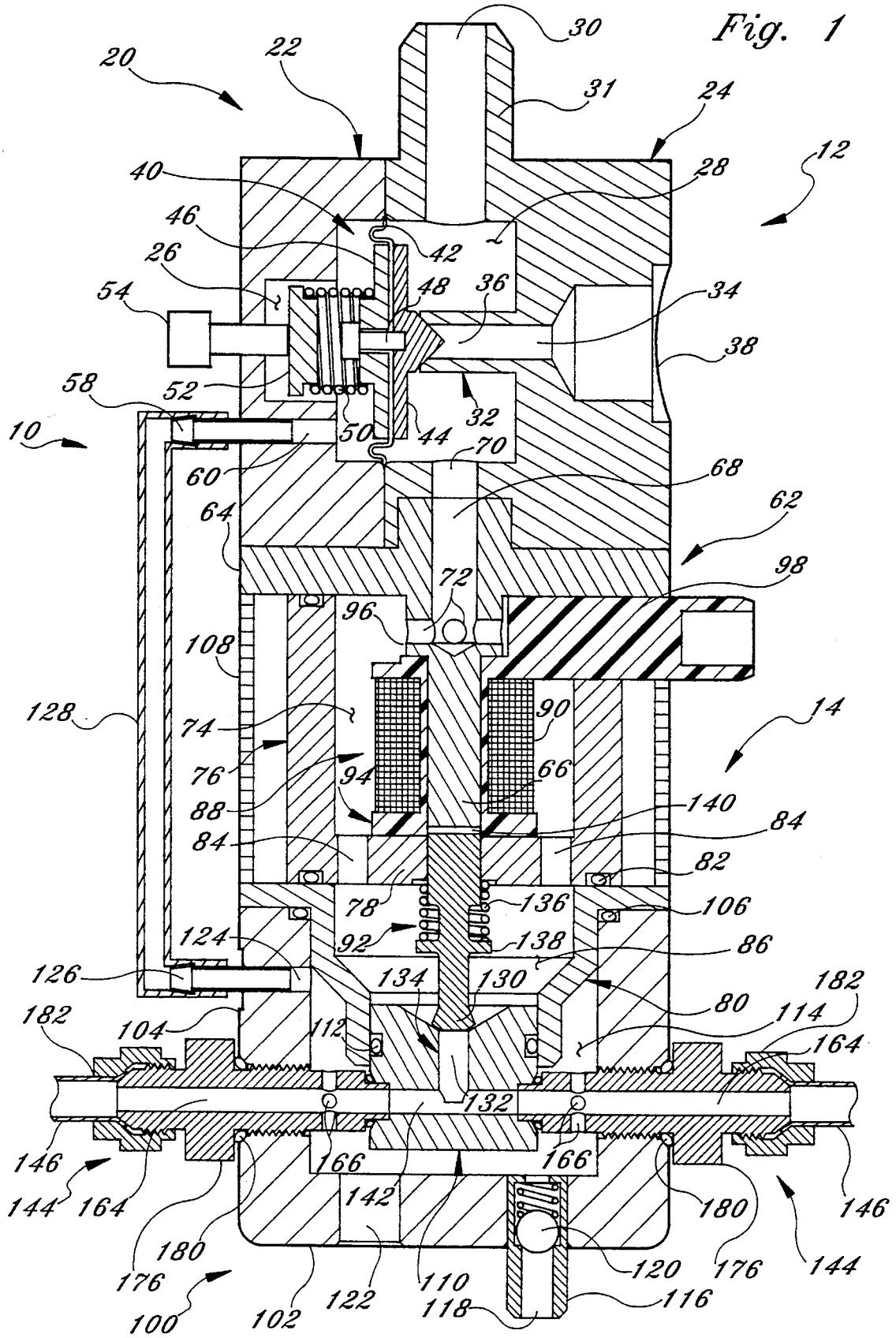
FIG. 1 is a cross-sectional view of the combined fuel regulator and single point metering device of this invention.

Referring now to FIG. 1, the fuel injector system 10 of this invention includes a fuel regulator 12 which is mounted to a single point fuel injector 14. The injector 14, in turn, is connected by a number of tubes 16 to separate nozzle injectors (not shown) each located at the inlet port of a cylinder of an internal combustion engine. The fuel regulator 12 and single point injector 14 are described separately below, followed by a discussion of the operation of system 10.

Fuel Regulator

Referring to the upper portion of FIG. 1, the fuel regulator 12 comprises a two-piece housing 20 including a lefthand portion 22 and a righthand portion 24 which are interconnected by screws or other suitable fasteners (not shown). The term "left" as utilized herein refers to the left side of the drawing as depicted in FIG. 1, and "right" refers to the opposite side of such FIG. The terms "upper" and "lower" refer to the top and bottom portions, respectively, of the system 10 in the orientation depicted in FIG. 1.

The lefthand portion 22 of housing 20 is formed with a stepped bore which defines a back pressure cavity 26. The back pressure cavity 26 is oriented in alignment with a fuel inlet cavity 28 defined by a cylindrical bore formed in the righthand portion 24 of housing 20. As depicted in FIG. 1, the fuel inlet cavity 28 intersects a bore 30 formed in an inlet 31 at the top of the righthand portion 24 of housing 20. In the presently preferred embodiment, a cylindrical extension 32 is integrally formed in the righthand portion 24 of housing 30 which is positioned within the fuel inlet cavity 28. The extension 32 is formed with a dump passageway 34 having an inlet 36 within the fuel inlet cavity 28, and an outlet 38 which communicates externally of the righthand portion 24 of housing 20.

The back pressure cavity 26 and fuel inlet cavity 28 are separated by a diaphragm-type, fuel regulator 40. The fuel regulator 40 includes a diaphragm 42 sandwiched between a regulator tip 44 and a flange 46 which are interconnected by a pin 48. As depicted in FIG. 1, the diaphragm 42 is connected at opposite ends to the point at which the left and righthand portions 22, 24 of housing 20 abut one another, and thus it separates the back pressure cavity 26 from the fuel inlet cavity 28. The regulator tip 44 is urged into contact with the inlet 36 of extension 32 by a return spring 50 extending between the flange 46 and a T-shaped head portion 52 of fuel regulator 40. This head portion 52 is engaged by an adjustment screw 54 which extends through a threaded bore formed in the lefthand portion 22 of housing 20 so that the stem of adjustment screw 54 contacts the head portion 52. Additionally, an inlet fitting 58 is inserted within a bore 60 formed in the lefthand portion 22 of housing 20. The bore 60, in turn, is connected to the back pressure cavity 26, for purposes to become apparent below.

Single Point Injector

Referring now to the middle and bottom portions of FIG. 1, the single point injector 14 is mounted to the fuel regulator 12 by a generally T-shaped flange 62 having a head portion 64 which abuts the righthand portion 24 of housing 20 of fuel regulator 12, and a stem portion 66 extending downwardly into the injector 14. Preferably, the connector 62 is formed of a magnetic material such as steel or the like. The head portion 64 of flange 62 has a bore 68 which intersects a connector bore 70 formed within the righthand portion 24 of housing 20 in position to intersect the fuel inlet cavity 28. The base of bore 68 is intersected by a number of outlet ports 72 which extend into the hollow interior 74 of a cylindrical support 76. The cylindrical support 76 has a base 78 which rests atop the upper surface of a tapered mount 80, with an o-ring 82 positioned therebetween. Preferably, the base 78 of cylindrical support 76 is formed with a number of outlet bores 84 which communicate with the interior of tapered mount 80. As described more fully below, the interior of tapered mount 80 forms a fuel outlet cavity 86.

In the presently preferred embodiment, the hollow interior 74 of cylindrical support 76 mounts a solenoid valve 88 including a coil 90 and a valve plunger 92. The metallic stem portion 66 of flange 62 extends into the interior of coil 90 forming the pole piece of solenoid valve 88. The coil 90 is wound on a coil bobbin 94 of solenoid valve 88 which, in turn, extends between the base 78 of cylindrical support 76 and a shoulder 96 formed in the stem portion 66 of connector 62. The coil bobbin 94 also includes an electrical connector 98 which extends externally of the injector 14 and is adapted to connect to a source of electrical power which operates the solenoid valve 88. Preferably, the coil bobbin 94 and electrical connector 98 are formed of a dielectric material such as plastic.

The bottom portion of injector 14 is formed by a cup shaped injector base 100 having a bottom wall 102 and a cylindrical shaped side wall 104 defining a hollow interior. The side wall 104 extends upwardly from the bottom wall 102 so that the tapered mount 80 is sandwiched between the upper surface of side wall 104 and the base of cylindrical support 76. Preferably, an o-ring 106 is positioned between the tapered mount 80 and the top of side wall 104 of injector base 100. Additionally, an outer wall 108 is provided to enclose the cylindrical support 76 within the interior of injector 14. This outer wall 108 extends between the tapered mount 80 at the bottom, the flange 62 at the lefthand side, and, the electrical connector 98 at the righthand side.

As shown at the bottom of FIG. 1, the hollow interior of injector base 100 receives a fuel distribution block 110 which is held in position therein by the bottom portion of tapered mount 80. An o-ring 112 is located between the fuel distribution block 110 and the tapered mount 80 to create a fluid tight seal therebetween. With the fuel distribution block 110 in position within the hollow interior of injector base 100, the fuel outlet cavity 86 is defined by that portion of the interior of tapered mount 80 located above the fuel distribution block 110. The remainder of the interior of injector base 100 forms an air chamber 114 which extends along a portion of the exterior of tapered mount 80 and generally downwardly from the fuel distribution block 110 to the bottom wall 102 of injector base 100. The air chamber 114 is connected to a source of ambient air by a cylindrical insert 116 extending through the bottom wall 102 of injector base 100. This insert 116 has a throughbore 118 within which a one-way valve 120 is mounted. The bottom wall 102 of injector base 100 is also formed with an air inlet port 122 which is adapted to connect to a source of pressurized air such as a turbocharger or supercharger (not shown) as discussed in more detail below. Additionally, the side wall 104 of injector base 100 is formed with an air outlet port 124 which mounts a fitting 126 connected by a transfer line 128 to the inlet fitting 58 associated with fuel regulator 12, for purposes to become apparent below.

As shown at the bottom portion of FIG. 1, the valve plunger 92 of solenoid valve 88 is located within the fuel outlet cavity 86 defined by the tapered mount 80 and fuel distribution block 110. The valve plunger 92 has a valve tip 130 which is engageable with the inlet 132 of a central bore 134 formed in the fuel distribution block 110. The valve plunger 92 is normally urged into a closed position, i.e. with the valve tip 130 in engagement with inlet 132, by a return spring 136 extending between a flange 138 formed along the valve plunger 92 and the base 78 of cylindrical support 76. A gap 140 is provided between the top of valve plunger 92 and the bottom of the stem portion 66 of flange 62. As described in more detail below, in response to activation of the solenoid valve 88, the valve plunger 92 is pulled upwardly into engagement with the stem portion 66 of connector 62 to unseat the valve tip 130 from the inlet 132 of central bore 134 and permit the flow of fuel from the fuel outlet cavity 86 into the central bore 134 of fuel distribution block 110.

In the presently preferred embodiment, the fuel distribution block 110 is formed with a number of distribution passages 142 which extend radially outwardly from the central bore 134 to the outermost surface of the fuel distribution block 110. Each of these distribution passages 142 mounts an air-fuel nozzle 144 in the position shown at the bottom portion of FIG. 1. The air-fuel nozzles 144, in turn, are each connected by a tube 146 to one of the cylinders of an internal combustion engine (not shown). Consequently, there is one air-fuel nozzle 144 for each cylinder of the engine, and a separate tube 146 interconnects each air-fuel nozzle 144 with one of the engine cylinders. Preferably, a nozzle injector is provided at the opposite end of tubes 146 to spray an air-fuel mixture into the inlet port of each engine cylinder (not shown). The particular configuration of the nozzle injector located at the engine forms no part of this invention per se, and the details of same are therefore not described herein. It is contemplated that nozzle injectors of the type made by Fuel Injection Engineering Company, Inc. of South Laguna, Calif. would be suitable for use for this purpose.

Air-Fuel Nozzles

With reference to FIGS. 2–5*b*, alternative embodiments of air-fuel nozzles 144 are illustrated in more detail. For purposes of the present discussion, the air-fuel nozzles are collectively referred to with the reference number 144, and individually described with the addition of a letter to such reference number, e.g. 144*a*, 144*b* etc.

Figure 2:
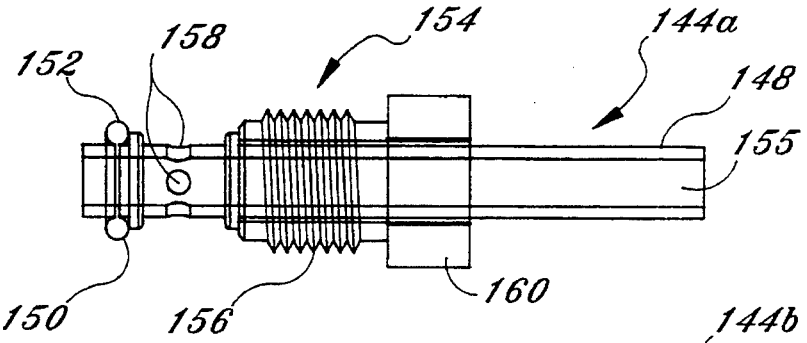
FIGS. 2–4, 5A and 5B depict alternative embodiments of the air-fuel nozzle employed in the injector herein.

The air-fuel nozzle 144*a* of FIG. 2 comprises an elongated length of tubing 148, a portion of which is depicted in FIG. 2, preferably formed of the same material used in standard fuel-carrying lines in vehicles. The inner end of tubing 148 carries a seat 150 which mounts an o-ring 152. A fitting 154, preferably formed of metal and having external threads 156, is connected to the tubing 148 at a location spaced from the o-ring 152. A number of air inlet ports 158 are formed in the tubing 148 between the o-ring 152 and fitting 154, which intersect the hollow interior 155 of tubing 148. Preferably, four air inlet ports 158 are provided which are spaced about 90° apart along the circumference of tubing 148. Additionally, the outer portion of fitting 154 mounts a flange 160. For purposes of the present discussion the term "inner" refers to a direction internally of the injector 14 with the nozzle 144*a* placed in an assembled position as shown in FIG. 1, and the term "outer" refers to the opposite direction. The air-fuel nozzle 144*a* is mounted to the injector base 100 and fuel distribution block 110 by inserting the inner end of nozzle 144*a* through the side wall 104 of injector base 100 and threading the fitting 154 therein. In the assembled position, the o-ring 152 of nozzle 144*a* engages the fuel distribution block 110 at an outlet of one of the distribution passages 142, and the flange 160 of nozzle 144*a* abuts the exterior of the injector side wall 104.

Figure 3:
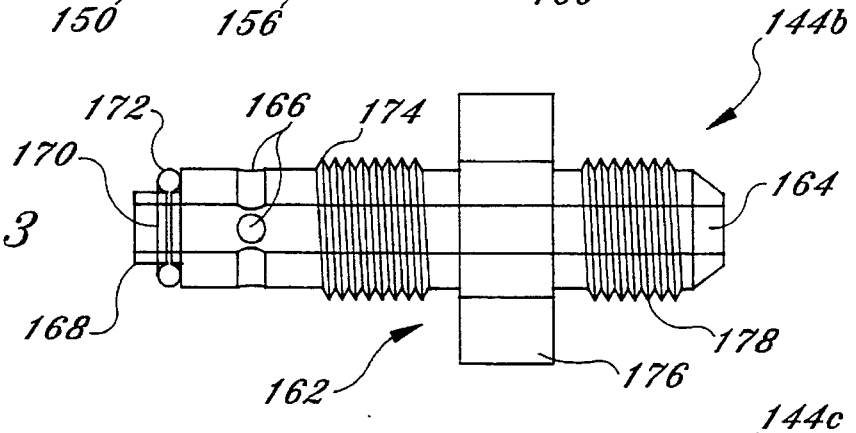

The air-fuel nozzle 144*b* depicted in FIG. 3 is the same as that shown at the base of FIG. 1. Nozzle 144*b* comprises a cylinder 162, preferably formed of metal, having a throughbore 164 which is intersected by a number of air inlet ports 166 oriented substantially perpendicularly thereto. Four air inlet ports 166 are provided in the preferred embodiment, positioned about 90° apart along the circumference of cylinder 162. The inner end of cylinder 162 has a reduced diameter portion 168 carrying a seat 170 which mounts an o-ring 172. The cylinder 162 is formed with first external threads 174 located between the air inlet ports 166 and a flange 176 mounted thereto, and second external threads 178 are formed along the cylinder 162 outwardly from the flange 176. The air-fuel nozzle 144*b* is connected to the injector base 100 as depicted in FIG. 1 with an o-ring 180 positioned between the flange 176 and the side wall 104 of injector base 100. As with each of the air-fuel nozzles 144*b–d* shown in FIGS. 3–5*b*, the external threads 178 of air-fuel nozzle 144*b* mount a coupler 182 connected to the tube 146 leading to one of the engine cylinders.

Figure 4:
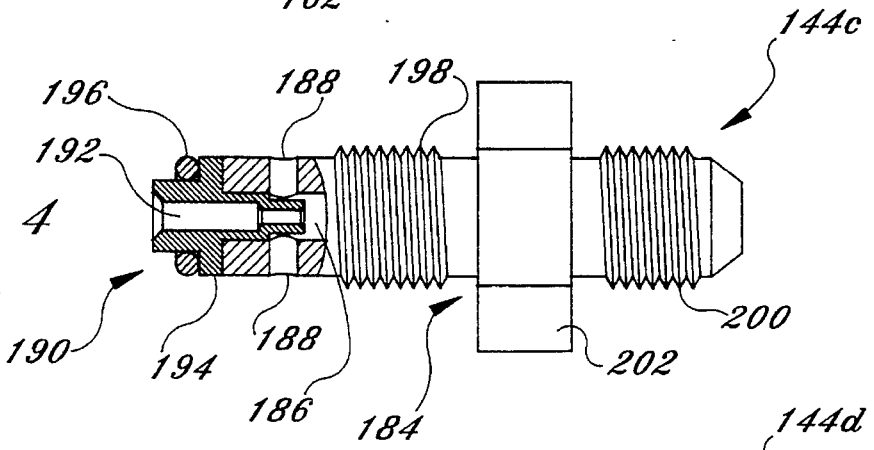

With reference to FIG. 4, an air-fuel nozzle 144*c* is shown comprising a cylinder 184, preferably formed of metal, having a throughbore 186 intersected by a number of air inlet ports 188. In the illustrated embodiment, four air inlet ports 188 are preferably oriented perpendicularly to the throughbore 186 and are spaced approximately 90° apart about the circumference of cylinder 184. The inner end of throughbore 186 mounts an insert 190 having a stepped throughbore 192 and a flange 194 which abuts the inner end of cylinder 184. The opposite end of flange 194 carries an o-ring 196 which is engageable with the outer wall of fuel distribution block 110 when the air-fuel nozzle 144*c* is mounted in position to the injector base 100. The cylinder 184 is formed with first external threads 198 and second external threads 200 located on opposite sides of a flange 202 which, as in the other embodiments, abuts the side wall 104 of injector base 100 in the assembled position of air-fuel nozzle 144*c*.

The purpose of the insert 190 of air-fuel nozzle 144*c* is twofold. First, the stepped throughbore 192 of insert 190 assists in atomizing fuel which is supplied from the fuel distribution block 110 in a manner described more fully below. As shown in FIG. 4, the outlet of stepped throughbore 192 of insert 190 is located slightly downstream from the air inlet ports 188 so that air is intermixed with the atomized fuel. Secondly, the stepped throughbore 192 of insert 190 functions to meter the flow of fuel through the air-fuel nozzle 144*c*, and, hence, to the engine cylinder. It is contemplated that different inserts 190 may be utilized within the air-fuel nozzle 144*c*, having stepped throughbores 192 of different dimension, to provide a simple and inexpensive means of further controlling the quantity of fuel supplied from the injector 14 to the engine cylinders.

Figure 5A:
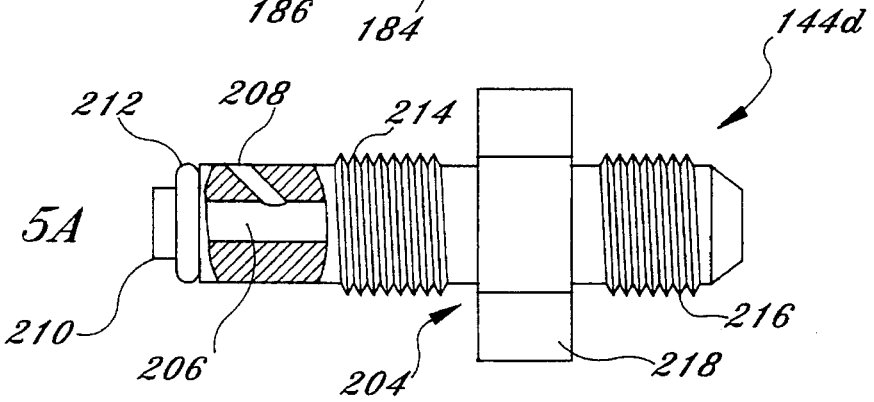
Figure 5B:
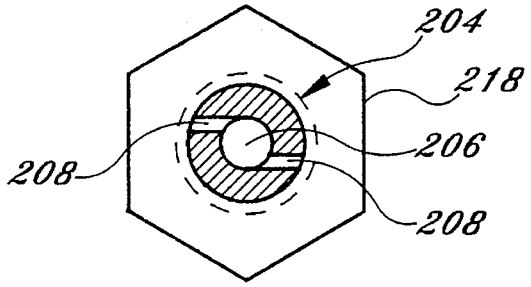

Referring now to FIGS. 5A and 5B, a still further embodiment of an air-fuel nozzle 144*d* is shown. The air-fuel nozzle 144*d* comprises a cylinder 204, preferably formed of metal, having a throughbore 206 which is intersected by at least two of air inlet ports 208. Unlike the previous embodiments, the air inlet ports of air-fuel nozzle 144*d* are oriented to intersect the throughbore 206 substantially tangentially thereto. See FIG. 5B. It is believed that the tangential intersection of the air inlet ports 208 with throughbore 206 enhances the intermixture of air and fuel within the air-fuel nozzle 144*d* before it is transmitted to the engine cylinders. As shown in FIG. 5A, the inner end of cylinder 204 has a reduced diameter portion 210 which mounts an o-ring 212 engageable with fuel distribution block 110. Additionally, first and second external threads 214, 216 are formed on the cylinder 204 on either side of a flange 218. The air-fuel nozzle 144*d* is assembled to the injector base 100 in the same manner as each of the other nozzles 144*a–c*, and receives the coupler 182 connected to tube 146 as with nozzles 144*b* and *c*.

Operation of System

Referring now to FIG. 1, the operation of system 10 proceeds as follows. Fuel is introduced into the inlet 30 of regulator 12 from the fuel pump of the internal combustion engine at a predetermined pressure. The fuel enters the fuel inlet cavity 28 of regulator 12 and then passes through the connector bore 70 in the righthand portion 24 of regulator housing 20 into the bore 68 formed in the stem portion 66 of flange 62. In the course of movement through the fuel inlet cavity 28, the fuel contacts the fuel regulator 40 which is operative to maintain the pressure of the fuel below a predetermined, maximum level. For example, if the fuel entering the fuel inlet cavity 28 exceeds the maximum pressure, the diaphragm 42 and return spring 50 of fuel regulator 40 are forced to the left as viewed in FIG. 1 thus unseating the regulator tip 44 from the inlet 36 of dump passageway 34 within the cylindrical extension 32. This causes fuel to exit the fuel inlet cavity 28 through the dump passageway 34, which reduces the pressure within the fuel inlet cavity 28. When the pressure has returned to the desired level, the return spring 50 forces the flange 46, diaphragm 42 and regulator tip 44 to the right as viewed in FIG. 1, so that the regulator tip 44 again seats against the inlet 36 to dump passageway 34. It can be appreciated that the pressure required to unseat the regulator tip 44 can be varied by the adjustment screw 54. The adjustment screw 54 is movable inwardly or outwardly with respect to the head portion 52 of diaphragm fuel regulator 40 thus increasing or decreasing, respectively, the force with which the return spring 50 urges regulator tip 44 against the inlet 36 of dump passageway 34. Consequently, the desired pressure at which the fuel is supplied from the fuel regulator 12 to the injector 14 can be readily controlled by the fuel regulator 12 which forms an integral part of the system 10 of this invention.

Referring to the center portion of FIG. 1, the fuel entering the bore 68 within the stem portion 66 of flange 62 exits the outlet ports 72 therein and is directed into the hollow interior 74 of cylindrical support 76. Within the hollow interior 74, the fuel washes over the coil 90 of solenoid valve 88 and is effective to at least partially cool the coil 90 during operation of system 10. The fuel passes through the outlet bores 84 in the base 78 of cylindrical support 76, and enters the fuel outlet cavity 86 above the fuel distribution block 110.

As mentioned above, the coil 90 of solenoid valve 88, when actuated, is effective to pull the valve plunger 92 vertically upwardly across the gap 140 between the top of valve plunger 92 and the base of the stem portion 66 of flange 62. This causes the valve tip 130 of plunger 92 to unseat from the inlet 132 of central bore 134 within fuel distribution block 110. The solenoid valve 88 is operated to unseat valve plunger 92 for predetermined time periods during operation of system 10 to allow precisely metered quantities of fuel to exit the fuel outlet cavity 86 and flow into the central bore 134 of fuel distribution block 110. The fuel that is permitted to flow into the fuel distribution block 110 passes through the central bore 134 therein, is equally distributed within each of the distribution passages 142 and then enters a respective air-fuel nozzle 144*a, b, c* or *d*.

With reference to air-fuel nozzle 144*b*, for example, the fuel enters its throughbore 164 directly from the associated distribution passage 142. Importantly, each air-fuel nozzle 144*b*, and each of the other air-fuel nozzles depicted in FIGS. 2–5B, is directly connected to the fuel distribution block 110 with no air gap or other spacing therebetween. An uninterrupted flow path is therefore provided from the central bore 134 and each distribution passage 142 of fuel distribution block 110, to and through each air-fuel nozzle 144*b*. In the course of movement of the fuel through air-fuel nozzles 144*b*, air is drawn into the throughbores 164 thereof via the air inlet ports 166. This air flow is supplied from air chamber 114 which, in turn, receives air through insert 116 and one-way valve 120. The air from air chamber 114 is intermixed with the fuel within the nozzle throughbore 164, and this air-fuel mixture then exits the nozzle 144*b* and enters the tube 146 for supply to the engine cylinders (not shown).

It should be understood that each of the other air-fuel nozzles 144*a*, 144*c* and 144*d* operate in essentially the same manner as described above in connection with nozzle 144*b*. The only differences are as described above, e.g. with the fuel metering and enhanced atomization capability provided by the insert 190 of air-fuel nozzle 144*c*, and the enhanced air-fuel intermixing capability provided by the tangential air inlet ports 208 of air-fuel nozzle 144d. Otherwise, all of the air-fuel nozzles 144*a–d* function in a similar manner.

Under the operating conditions described above, wherein a flow of ambient air is introduced into the air chamber 114 through insert 116, a pressure drop exists between the fuel outlet cavity 86 and the downstream portion of the injector 14, e.g. the distribution passages 142 within the fuel distribution block 110 and the throughbore in each air-fuel nozzles 144. One advantage of the system 10 of this invention is that such pressure drop can be maintained even when it is utilized with a forced induction injection system such as a turbocharger or supercharger.

As mentioned above, the bottom wall 102 of injector base 100 is formed with a second air inlet port 122 connectable to a turbocharger or supercharger (not shown). When using forced induction systems of this type, pressurized air is introduced through port 122 into the air chamber 114 for intermixture with the fuel supplied through the fuel distribution block 110 to the nozzles 144. In order to maintain a constant pressure drop between fuel outlet cavity 86 and the fuel distribution block 110 under these conditions, pressurized air is transferred from the air chamber 114 into the back pressure cavity 26 of fuel regulator 12. As shown in FIG. 1, the air chamber 114 is connected by air outlet port 124, fitting 126 and transfer line 128 to the fitting 58 carried within bore 60 connected to the back pressure cavity 26 of fuel regulator 12. When pressurized air is introduced into the air cheer 114, the back pressure cavity 26 is therefore also pressurized to the same extent. The pressurized air within back pressure cavity 26 augments the pressure with which return spring 50 urges the regulator tip 44 against the inlet 36 to dump passageway 34. As a result, the pressure of the fuel entering fuel inlet cavity 28 can be increased in an amount substantially equal to that of the pressurized air within air chamber 114 and back pressure cavity 26 without unseating the regulator tip 44 from the dump passageway 34. In turn, the pressure of the fuel flowing from the regulator 12 into the fuel outlet cavity 86 of the injector 14 is increased to a substantially equal extent. The net pressure drop between fuel outlet cavity 86 and the distribution passages 142 within the fuel distribution block 110 is therefore substantially the same as the pressure drop therebetween when the system 10 utilized with ambient air instead of a forced induction turbocharger or supercharger system. It should be noted that during forced induction operation of the system 10, the check valve 120 within insert 116 prevents the escape of air from the air chamber 114 through insert 116, thus allowing the system 10 to operate with a turbocharger or supercharger, as desired.

It is also contemplated that the interconnection between the air chamber 114 of injector 14 and back pressure cavity 26 of fuel regulator 12 will also be advantageous in normally aspirated engines wherein a pressure drop is created within air chamber 114. Such pressure drop within air chamber 114 can occur during different operating speeds of the engine, and, if not accounted for, results in a greater than desired pressure differential between the fuel outlet cavity 86 and the passages 142 within fuel distribution block 110. In this operating situation, a slightly negative pressure is produced within back pressure cavity 26 due to its interconnection with air chamber 114 thus proportionately reducing the force required to unseat the regulator tip 44 from dump passage 34, which, in turn, reduces the pressure of the fuel discharged from regulator 12 into injector 14. As a result, the pressure drop or differential across the fuel distribution block 110 is maintained even when the pressure within air chamber 114 is reduced.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. Apparatus for supplying an air-fuel mixture to the cylinders of an internal combustion engine, comprising:

an injector base formed with a bottom wall and a sidewall defining a hollow interior;

a fuel distribution block supported within said hollow interior of said injector base in position to form an air chamber on one side thereof and a fuel cavity on the opposite side thereof which is adapted to communicate with a source of fuel, said fuel distribution block being formed with a bore and a number of distribution passages connected to said bore;

a valve, carried at least partially within said fuel cavity, which is movable between an open position and a closed position with respect to said bore in said fuel distribution block;

a number of air-fuel nozzles each formed with a throughbore having an inlet and at least one air inlet port which intersects said throughbore, each of said air-fuel nozzles being mounted to said injector base so that said inlet of said throughbore thereof is connected to one of said distribution passages and said at least one air inlet port thereof is positioned within said air chamber, said distribution passages of said fuel distribution block each transmitting fuel into said throughbore of one of said air-fuel nozzles connected thereto wherein said fuel is intermixed with air entering said throughbore from said at least one air inlet port to form an air-fuel mixture.

2. The apparatus of claim 1 in which said injector base is formed with an ambient air inlet carrying a one-way valve.

3. The apparatus of claim 2 in which said injector base is formed with a second air inlet adapted to be connected to a source of pressurized air.

4. The apparatus of claim 1 in which said valve is a solenoid valve having a plunger movable with respect to the inlet of said bore in said fuel distribution block between an open position and a closed position.

5. The apparatus of claim 1 in which each of said air-fuel nozzles is formed with a number of air inlet ports which substantially perpendicularly intersect said throughbore thereof.

6. The apparatus of claim 1 in which each of said air-fuel nozzles is formed with a number of air inlet ports which tangentially intersect said throughbore thereof.

7. The apparatus of claim 1 in which each of said air-fuel nozzles includes a section of tubing having a hollow interior, said tubing having an inner end mounting an o-ring which is engageable with one of said distribution passages formed in said fuel distribution block and a fitting formed with external threads which includes a flange, said tubing being formed with a number of said air inlet ports located between said o-ring and said fitting.

8. The apparatus of claim 1 in which each of said air-fuel nozzles is formed of a cylinder having a throughbore, an inner end and an outer end, said inner end of said cylinder mounting an o-ring which is engageable with one of said distribution passages formed in said fuel distribution block, said cylinder being formed with a number of said air inlet Ports which intersect said throughbore, said cylinder mounting a flange and being formed with first external threads and second external threads located on either side of said flange.

9. The apparatus of claim 1 in which each of said air-fuel nozzles is formed of a cylinder having a throughbore, an inner end and an outer end, said inner end of said cylinder mounting an insert formed with a stepped bore, said insert extending into said throughbore of said cylinder.

10. The apparatus of claim 9 in which said cylinder includes a number of air inlet ports which intersect said throughbore.

11. The apparatus of claim 9 in which said insert is formed with a flange, one side of said flange abutting said inner end of said cylinder and the other side of said flange abutting an o-ring.

12. The apparatus of claim 9 in which said cylinder mounts a flange and is formed with first external threads and second external threads located on either side of said flange.

13. The apparatus of claim 1 in which each of said air-fuel nozzles is formed of a cylinder having a throughbore, an inner end and an outer end, said inner end of said cylinder mounting an o-ring which is engageable with one of said distribution passages formed in said fuel distribution block, said cylinder being formed with a number of said air inlet ports which tangentially intersect said throughbore, said cylinder mounting a flange and being formed with first external threads and second external threads located on either side of said flange.

14. Apparatus for supplying an air-fuel mixture to the cylinders of an internal combustion engine, comprising:

a fuel regulator including:

(i) a housing formed with a fuel inlet chamber having an inlet and an outlet;

(ii) a pressure regulating device carried within said fuel inlet chamber, said pressure regulating device having a regulator tip movable with respect to the inlet of a dump passage connected to said fuel cavity in response to changes in fuel pressure within said fuel cavity;

a fuel injector mounted to said fuel regulator, said fuel injector including:

(i) an injector base formed with a bottom wall and a sidewall defining a hollow interior;

(ii) a fuel distribution block supported within said hollow interior of said injector base in position to form an air chamber on one side thereof and a fuel outlet cavity on the opposite side thereof which is connected to said outlet of said fuel inlet chamber, said fuel distribution block being formed with a bore and a number of distribution passages connected to said bore;

(iii) a valve, carried at least partially within said fuel inlet chamber, which is movable between an open position and a closed position with respect to said bore in said fuel distribution block;

(iv) a number of air-fuel nozzles each formed with a throughbore having an inlet and at least one air inlet port which intersects said throughbore, each of said air-fuel nozzles being mounted to said injector base so that said inlet of said throughbore thereof is connected to one of said distribution passages and said at least one air inlet port thereof is positioned within said air chamber, said distribution passages of said fuel distribution block each transmitting fuel into said throughbore of one of said air-fuel nozzles connected thereto wherein said fuel is intermixed with air entering said throughbore from said at least one air inlet port to form an air-fuel mixture.

15. The apparatus of claim 14 in which said pressure regulating device is a diaphragm pressure regulator including a flange, a regulator tip and a flexible diaphragm sandwiched between said flange and said regulator tip.

16. The apparatus of claim 15 in which said housing of said fuel regulator is formed with an extension having a dump passage with an inlet, said regulator tip being movable with respect to said inlet of said dump passage.

17. The apparatus of claim 16 in which said fuel regulator is formed with a head portion engageable with an adjustment screw and a spring extending between said head portion and said flange, said spring being effective to urge said regulator tip toward said inlet of said dump passage within said extension.

18. The apparatus of claim 17 in which said adjustment screw is movable relative to said head portion of said fuel regulator to vary the force with which said spring urges said regulator tip into engagement with said inlet of said dump passage.

19. The apparatus of claim 14 in which said housing of said fuel regulator is formed with a back pressure chamber located on the opposite side of said pressure regulating device from said fuel inlet chamber, said back pressure chamber being connected to said air chamber within said injector base of said fuel injector.

20. The apparatus of claim 19 in which said back pressure chamber is located with respect to said pressure regulating device so as to force said pressure regulating device in a direction toward or away from said inlet of said dump passage.

21. The apparatus of claim 14 in which said injector base is formed with an ambient air inlet carrying a one-way valve.

22. The apparatus of claim 21 in which said injector base is formed with a second air inlet adapted to be connected to a source of pressurized air.

23. The apparatus of claim 14 in which said valve is a solenoid valve having a plunger movable with respect to the inlet of said bore in said fuel distribution block between an open position and a closed position.

24. The apparatus of claim 14 in which each of said air-fuel nozzles is formed with a number of air inlet ports which substantially perpendicularly intersect said throughbore thereof.

25. The apparatus of claim 14 in which each of said air-fuel nozzles is formed with a number of air inlet ports which tangentially intersect said throughbore thereof.

26. The apparatus of claim 14 in which each of said air-fuel nozzles includes a section of tubing having a hollow interior, said tubing having an inner end mounting an o-ring which is engageable with one of said distribution passages formed in said fuel distribution block and a fitting formed with external threads which includes a flange, said tubing being formed with a number of said air inlet ports located between said o-ring and said fitting.

27. The apparatus of claim 14 in which each of said air-fuel nozzles is formed of a cylinder having a throughbore, an inner end and an outer end, said inner end of said cylinder mounting an o-ring which is engageable with one of said distribution passages formed in said fuel distribution block, said cylinder being formed with a number of said air inlet ports which intersect said throughbore, said cylinder mounting a flange and being formed with first external threads and second external threads located on either side of said flange.

28. The apparatus of claim 14 in which each of said air-fuel nozzles is formed of a cylinder having a throughbore, an inner end and an outer end, said inner end of said cylinder mounting an insert formed with a stepped bore, said insert extending into said throughbore of said cylinder.

29. The apparatus of claim 28 in which said cylinder includes a number of air inlet ports which intersect said throughbore.

30. The apparatus of claim 28 in which said insert is formed with a flange, one side of said flange abutting said inner end of said cylinder and the other side of said flange abutting an o-ring.

31. The apparatus of claim 28 in which said cylinder mounts a flange and is formed with first external threads and second external threads located on either side of said flange.

32. The apparatus of claim 14 in which each of said air-fuel nozzles is formed of a cylinder having a throughbore, an inner end and an outer end, said inner end of said cylinder mounting an o-ring which is engageable with one of said distribution passages formed in said fuel distribution block, said cylinder being formed with a number of said air inlet ports which tangentially intersect said throughbore, said cylinder mounting a flange and being formed with first external threads and second external threads located on either side of said flange.

33. Apparatus for supplying an air-fuel mixture to the cylinders of an internal combustion engine, comprising:

a fuel regulator including:

(i) a housing formed with a fuel inlet chamber having an inlet and an outlet;

(ii) a pressure regulating device carried within said fuel inlet chamber, said pressure regulating device having a regulator tip movable with respect to the inlet of a dump passage connected to said fuel cavity in response to changes in fuel pressure within said fuel cavity;

a fuel injector mounted to said fuel regulator, said fuel injector including:

(i) an injector base formed with a bottom wall and a sidewall defining a hollow interior;

(ii) a fuel distribution block supported within said hollow interior of said injector base in position to form an air chamber on one side thereof and a fuel outlet cavity on the opposite side thereof which is connected to said outlet of said fuel inlet chamber, said fuel distribution block being formed with a bore and a number of distribution passages connected to said bore;

(iii) a valve, carried at least partially within said fuel inlet chamber, which is movable between an open position and a closed position with respect to said bore in said fuel distribution block;

(iv) a number of transfer devices, each communicating with one of said distribution passages of said fuel distribution block, for transmitting an air-fuel mixture from said injector base to a cylinder of an internal combustion engine.

34. Apparatus for supplying an air-fuel mixture to the cylinders of an internal combustion engine, comprising:

a fuel regulator including:

(i) a housing formed with a fuel inlet chamber having an inlet and an outlet;

(ii) a pressure regulating device carried within said fuel inlet chamber, said pressure regulating device having a regulator tip movable with respect to the inlet of a dump passage connected to said fuel cavity in response to changes in fuel pressure within said fuel cavity;

a fuel injector mounted to said fuel regulator, said fuel injector including:

(i) an injector base formed with a bottom wall and a sidewall defining a hollow interior;

(ii) a fuel distribution block supported within said hollow interior of said injector base in position to form a fuel outlet cavity which is connected to said outlet of said fuel inlet chamber, said fuel distribution block being formed with a bore and a number of distribution passages connected to said bore;

(iii) a valve, carried at least partially within said fuel inlet chamber, which is movable between an open position and a closed position with respect to said bore in said fuel distribution block;

(iv) a number of transfer devices, each communicating with one of said distribution passages of said fuel distribution block, for transmitting fuel from said fuel outlet cavity to a cylinder of an internal combustion engine.

* * * * *